US005328044A

United States Patent [19]

Röhrs et al.

[11] Patent Number: 5,328,044

[45] Date of Patent: Jul. 12, 1994

[54] CONTAINER CLOSURE WITH ORIGINALITY RING

[75] Inventors: Dirk Röhrs, Undenheim; Stefan Kreuzberger, Lorch am Rhein; Heino Deussen, Eltville am Rhein, all of Fed. Rep. of Germany

[73] Assignee: Stella Kunststofftechnik GmbH, Eltville a. Rhein, Fed. Rep. of Germany

[21] Appl. No.: 6,464

[22] Filed: Jan. 21, 1993

[30] Foreign Application Priority Data

Jan. 25, 1992 [DE] Fed. Rep. of Germany ..... 4201997

[51] Int. Cl.[5] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 4,196,818 | 4/1980 | Brownbill | 215/252 |
| 4,401,227 | 8/1983 | Pehr | 215/252 |
| 4,488,655 | 12/1984 | Itsubo et al. | 215/252 |
| 4,572,388 | 2/1986 | Luker et al. | 215/252 |
| 4,759,456 | 7/1988 | Kusz | 215/252 |
| 4,801,030 | 1/1989 | Barriac | 215/252 |
| 4,863,050 | 9/1989 | Perry | 215/252 |
| 4,978,017 | 12/1990 | McBride | 215/252 |

FOREIGN PATENT DOCUMENTS

| | | | |
|---|---|---|---|
| 4108453 | 10/1991 | Fed. Rep. of Germany . | |
| 1386624 | 3/1975 | United Kingdom | 215/252 |

*Primary Examiner*—Allan N. Shoap
*Assistant Examiner*—Vanessa Caretto
*Attorney, Agent, or Firm*—H. Gibner Lehmann; K. Gibner Lehmann

[57] ABSTRACT

A container closure having an originality ring which can be attached to a container with little force and easily removed, while making certain that the originality ring either detaches completely from the closure cap or is at least damaged visibly. The retaining elements comprise a rocker having first and second legs connected to the originality ring via an elastic web. The first leg points obliquely inward and the second leg points outward.

11 Claims, 7 Drawing Sheets

CONTAINER CLOSURE WITH ORIGINALITY RING

CROSS REFERENCES TO RELATED APPLICATIONS

The present application claims priority under 35 USC 119 of applicants' German Application No. P 42 01 997.4-23 filed Jan. 25, 1992, entitled "Behalterverschluss mit Originalitatsring", and having common ownership with the present application.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

The invention relates to a container closure comprising a closure cap which has at its free circumferential rim an originality ring with retaining elements which cooperate with an annular bead of the container.

2. Description of the Related Art including Information Disclosed under 37 CFR §§1.97–1.99

Container closures are usually provided with originality rings which are damaged when the container is opened for the first time. Thus, the user can find out from the condition of the originality ring whether or not the bottle or the container is still in its originally packed state.

From the view of the filler who applies the container closures to the containers as well as from the view of the user, different, partly opposing, requirements must be met by such container closures.

The container closures are screwed onto the container at a great rate of speed, i.e. at a high r.p.m. The originality ring or its retaining elements must offer only slight counterforces to this screw-on operation, because otherwise the originality ring may tear off prematurely and/or the retaining elements may be damaged. Also, the force expended should be kept to a minimum. But at the same time it must be made certain that the retaining elements grip the bottle bead sufficiently in the screwed-on state to guarantee that when unscrewing the container closure, no detachment of the originality ring from the container closure or at least no visible damage to the-originality ring occurs. On the other hand, however, a rugged design of the originality ring or firm connection of the originality ring to the closure cap, as desired from this point of view, must not lead to the user having to expend too much force when removing the container closure for the first time to be able to remove the closure cap.

These problems were only solved in part by the known originality closures. But one substantial disadvantage of the known container closures was that when opening the container for the first time the originality ring remained on the screw cap without visible damage worth noting. A container closure screwed back on again and showing only slight damage to the originality ring does not let the consumer recognize immediately that the container had already been opened.

Known from DE 41 08 453 A1 is a container closure in which the retaining elements are held together all around in a circle mutually spaced so as to be movable within limits. The collar of retaining members is designed by means of the connecting elements so that it can snap between two stable positions, namely between an outer position extending further from the originality ring and an inner position which extends from the originality ring into the latter's inside, becoming conically narrower. The latter position has the effect that the retaining elements support themselves against the annular bead of the container, causing the originality ring to be torn off when the container is opened for the first time. But this is assured only if the container neck is shaped in adaptation to the shape of the retaining elements so as to prevent the retaining members from snapping over when first opening the container closure. Given the usual design of container necks with a free space between retaining elements and container, a snapping over of the retaining members during the first opening cannot be excluded, and therefore the closure cap can be removed without visible damage.

Due to the one-piece design of originality ring and screw cap, both parts are joined together relatively firmly so that the user must either exert much force in order to remove the container closure, or else the originality ring remains hanging on the container closure. Despite their elasticity, the connecting elements between the retaining elements lead to a stiffening of the entire collar of retaining elements so that relatively great forces are required to screw the container closure on.

SUMMARY OF THE INVENTION

Therefore, the object of the invention is the creation of a container closure with originality ring which can be screwed onto the container using little force and which can be removed easily when opening the container for the first time, while making certain that for such first-time opening the originality ring either detaches completely from the closure cap or is at least visibly damaged.

According to the invention, the retaining elements are designed as rockers each with a first leg and a second leg which are joined to the originality assurance ring by a web that is common to both, the first leg pointing obliquely inward relative to the closure cap and the second pointing downward. As in the known retaining members according to the state of the art, the first leg assumes the task of gripping behind the annular bead on the container neck and of supporting itself against this annular bead when the container closure is unscrewed. This means that when the container closure is screwed on for the first time, this first leg must be moved along and across the annular bead. Due to the fact that the first leg forms a rocker with the second leg, which rocker is fastened to the originality ring by an elastic connecting web common to both legs, the first leg recedes in the direction of the originality ring when in contact with the annular bead of the container when the container closure is screwed on for the first time, without the first leg offering much resistance to this screw-on operation. Due to the elastic design of the connecting web which makes it possible for the first leg to recede, the first leg itself can be of relatively rugged and much less elastic design. The second leg, too, can be of relatively rugged and less elastic design, the point being that the first and the second legs are joined to each other relatively rigidly.

The elastic connecting web assures that the rocker, after bypassing the annular bead of the container, returns to its original position again far enough for the first leg to grip under the annular bead.

The second leg is adjusted in such a manner as not to hinder the screw-on operation materially. This means that it is so designed with respect to its length and alignment that it preferably does not come in contact with the annular bead of the container also during the screw-on operation and hence in rocked position. It is important in this connection that the second leg offer no resistance worth noting to the screw-on operation, not to speak of hindering the screw-on operation.

When the container is opened for the first time, the first leg's support surface, which is preferably designed to lie in horizontal direction, supports itself against the underside of the annular bead. The relatively rugged design of the first leg prevents it from deforming elastically far enough to that it could possibly move along the annular bead upon the first unscrewing so that no damage to the originality ring would occur.

Since during the first unscrewing the free end of the first leg is distanced increasingly from the originality ring there could, under circumstances, occur a snapping of the first leg without causing damage to the connection between the originality ring and the closure cap or to the originality ring itself. In order to prevent this effectively, the second leg is joined to the first leg in relatively rigid fashion, the second leg supporting itself against the originality ring. This limits the movement of the first leg, and the forces acting upon the elastic connecting web are reduced by the pressure exerted by the second leg on the originality ring.

In this manner, when the container closure is removed for the first time, the forces opposing the unscrewing operation are optimally transferred to the originality ring which is thereby caused to tear off and separate from the closure cap or is damaged.

The originality ring is preferably not of a one-piece design with the closure cap, but is rather fused to the closure cap. The originality ring may be fused to the closure cap over its entire circumferential face area, it being advantageous, however, for the originality ring to be joined to the closure cap at some separated points only. Because of the forces active during the first unscrewing operation, it must be seen to it that the connection between the originality ring and the closure cap, or the stability of the originality ring per se, is weaker than the elastic connection between the rocker and the originality ring. The loading capacity of the rocker must be greater than that of the areas which are intended to become damaged when removing the closure cap for the first time.

In advantageous embodiment, the first leg's free end is distanced further from the originality ring than the second leg's free end. This makes for a larger space between the first leg and the originality ring than between the second leg and the originality ring. Depending on the annular bead design at the container neck, it may be of advantage for the first leg to form an angle between 30 and 50 degrees with the originality ring. The length and inclination of the first leg should preferably be chosen so that when screwing the container closure on and the first leg makes contact for the first time, the connecting web is already at the lower edge of the annular bead or below it.

The space between the first leg and the originality ring makes it possible for the first leg to recede without problem when screwing the container closure on, while the smaller space between the second leg and the originality ring causes the second leg to be in contact with or abut the originality ring already after a short distance when unscrewing the container closure for the first time, thus limiting the mobility of the first leg to the extended blocking position shown in FIG. 7, at an early stage. The second legs and inner surface of the originality ring thus constitute an abuttable uni-directional blocking means located within the originality ring, for preventing pivotal movement of the first legs past their extended blocking positions illustrated in FIG. 7.

The second leg is preferably shorter than the first leg so that the latter does not touch the container in rocked position. If, for space reasons, a relatively narrow originality ring design, as viewed in axial direction, is desired, it is necessary to arrange the rocker as low as possible on the originality ring. In this case it must be seen to it that the second leg does not project below the originality ring so as to make manipulations on the part of the user impossible. From this aspect also, a relatively short design of the second leg is necessary.

The first leg is arranged pointing obliquely inward so that its outside surface slides across the annular bead when fastening the container closure as both legs perform their rocking motion, its free end gripping behind the annular bead in the closed position. For this purpose the inside surface of the first leg is designed as a sliding surface.

As viewed in circumferential direction of the container closure, the first leg may be of circular arc design. But it is of advantage if the radius of curvature of the first leg is greater than the radius of the annular bead because this results merely in a point contact which helps facilitate the screwing on process.

If the originality ring is provided all around with rockers, it is completely separated from the closure cap when the container closure is removed for the first time, and the originality ring remains on the container neck. It is thus immediately clear to the consumer that the container has already been opened.

However, the possibility exists to provide the rockers only in a limited section of the inner circumference, the originality ring having a predetermined breaking point in the immediate proximity of one of the two outer rockers. The originality ring is at least fastened to the closure cap on the side of the predetermined breaking point which faces away from the outer rocker, it also being possible to provide a connection with the closure cap in the entire area in which no rockers are provided. In the area of the rockers, the originality ring is not connected to the closure cap so that visible damage is caused during the first unscrewing. When the container closure is unscrewed for the first time, the originality ring is retained and stressed by the rockers provided in one section only in that particular area so that the originality ring also detaches from the closure cap in that area only, breaking the predetermined breaking point at the same time. Thus, visible damage is caused to the originality ring when the container is opened for the first time.

Advantageous embodiments of the invention are explained below in greater detail with reference to the drawings.

DESCRIPTION OF THE PREFERRED EMBODIMENT

Figure 1:
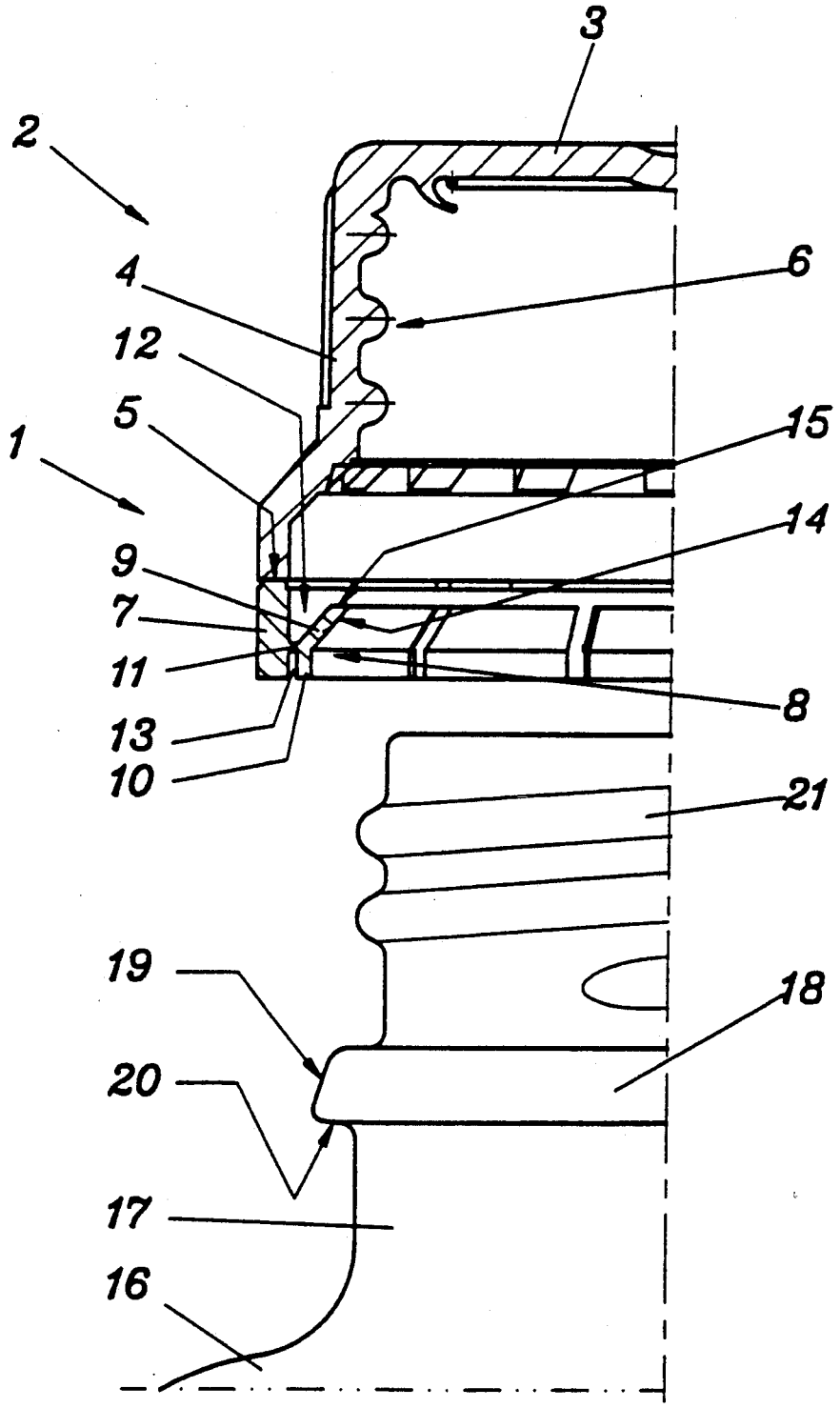
FIG. 1 shows the container closure in partial section in the not-screwed-on state.

In FIG. 1, the container closure is shown in partial section. By means of the container closure 1 the container 16 is closed. The container 16 has at its neck 17 an annular bead 18 and above it an external thread 21.

The closure cap 2 has a bottom wall 3 to close the container opening and a circumferential wall 4 which has on its inside an internal thread 6 to cooperate with the external thread 21 of the container 16. The outside wall 4 expands conically toward the bottom and has a face 5 to which the originality ring 7 is fastened. Arranged on the inside of the originality ring 7 via an elastic connecting web 11 are a number of rockers 8. Each rocker consists of a first leg 9 pointing obliquely upward into the interior of the closure cap and a second leg pointing downwardly. The first leg 9 is further away from the originality ring 7 than the second leg 10. This creates an upper space 12 which is larger than the lower space 13. The first leg 9 is longer than the second leg 10, the latter being aligned parallel to the wall of the originality ring 7.

Figure 2:
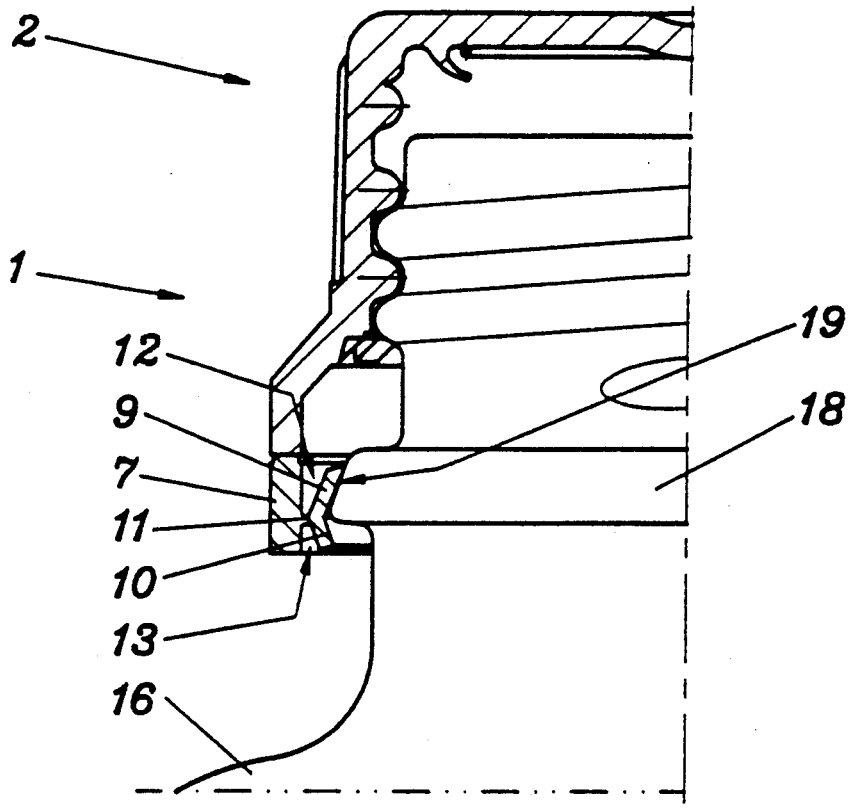
FIG. 2 shows the container closure in partial section in a partially screwed-on state.

In FIG. 2 is shown a first phase of the process of screwing on the container closure 1. The sliding surface 14 of the first leg 9 is in contact with the conical outside surface 19 of the annular bead 18 and recedes while reducing the space 12 relative to this annular bead 18. This causes the essentially rigidly interconnected legs 9 and 10 to perform a kind of rocking motion accompanied by an elastic bending of their common connecting web 11. During this screw-on operation, the second leg 10 does not touch this annular bead 18.

Figure 3:
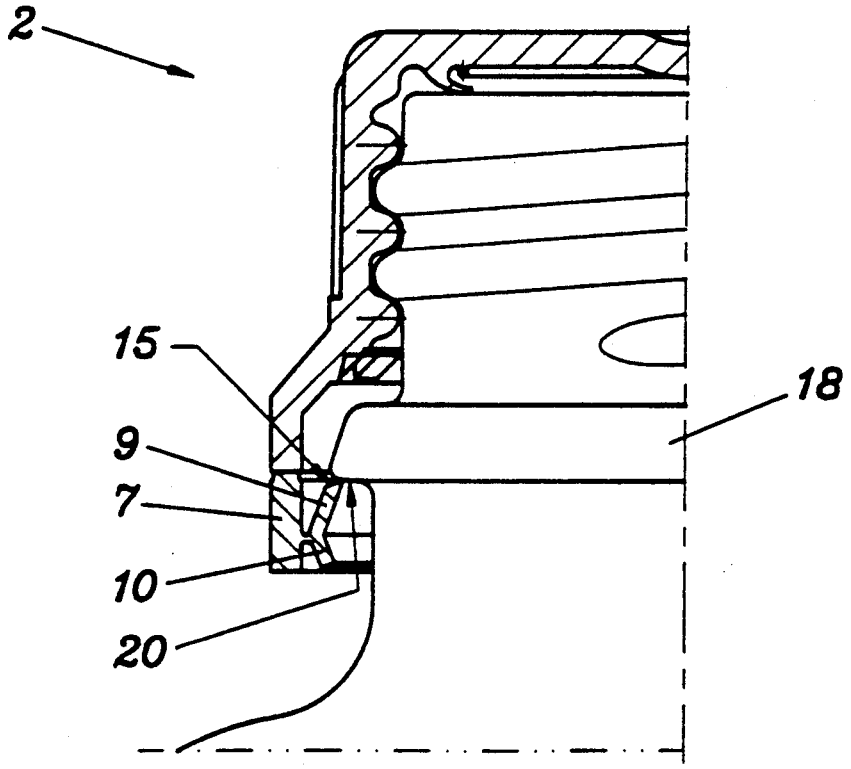
FIG. 3 shows the container closure in partial section in a partially screwed-on state.
Figure 4:
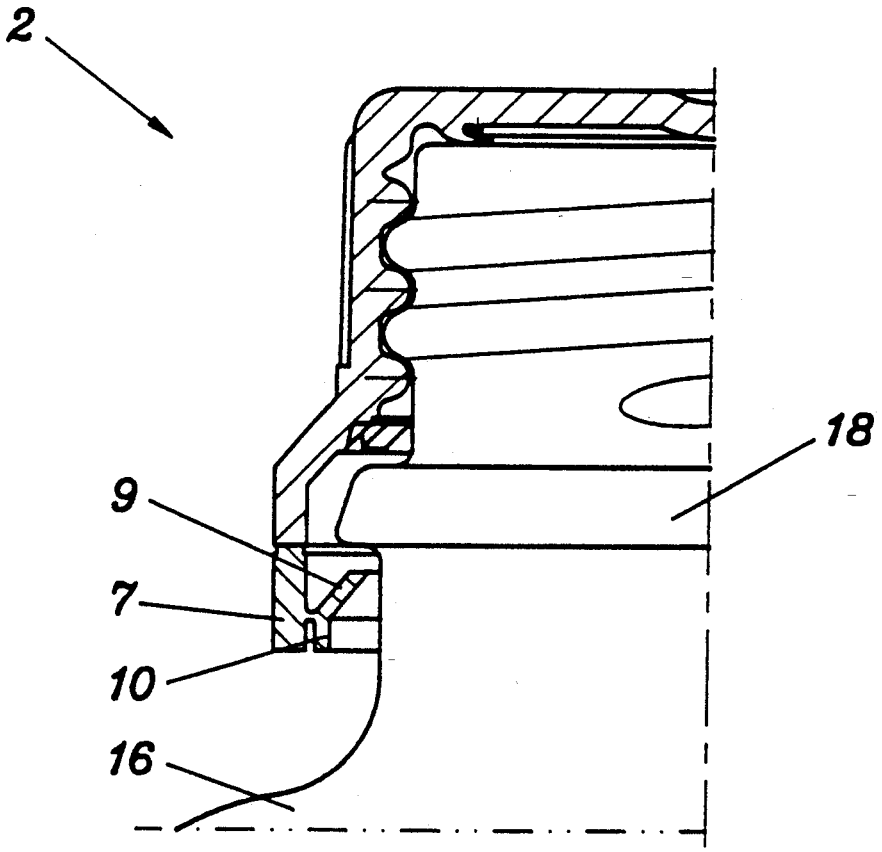
FIG. 4 shows the container closure in partial section in the completely screwed-on state.
Figure 6:
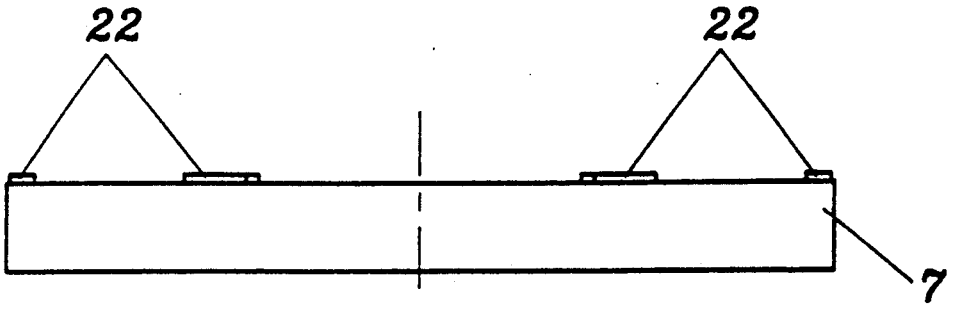
FIG. 6 shows the originality ring in side view.

Another phase of the screw-on operation is shown in FIG. 3. The first leg 9 moves towards the underside 20 of the annular bead 18, during which motion the supporting surface 15, which is essentially horizontal, now comes in contact with this underside 20. At the same time, the rocker 8 returns into its starting position. The end position of rocker 8 in the screwed-on state is shown in FIG. 4, the rocker 8 not touching the container 16.

Figure 5:
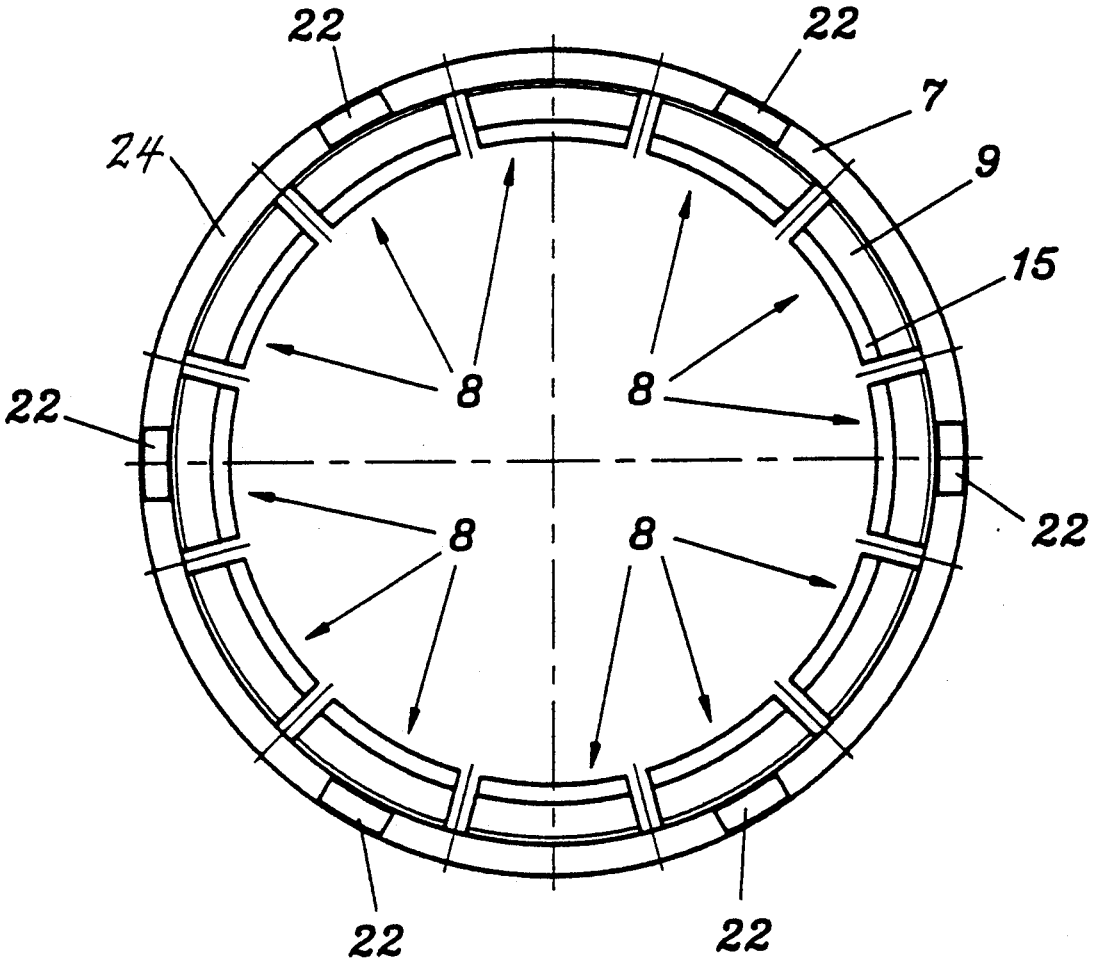
FIG. 5 is a top view of the originality ring.

In FIG. 5 is shown a top view of the originality ring 7. The rockers 8 are distributed over the entire inside circumference of the originality ring. The first legs 9 are of a circular arc design. Provided on the face 24 of the originality ring 7 are raised material sections 22 which serve to fuse the originality ring to the closure cap 2. A total of six such raised material sections 22 is provided.

Figure 7:
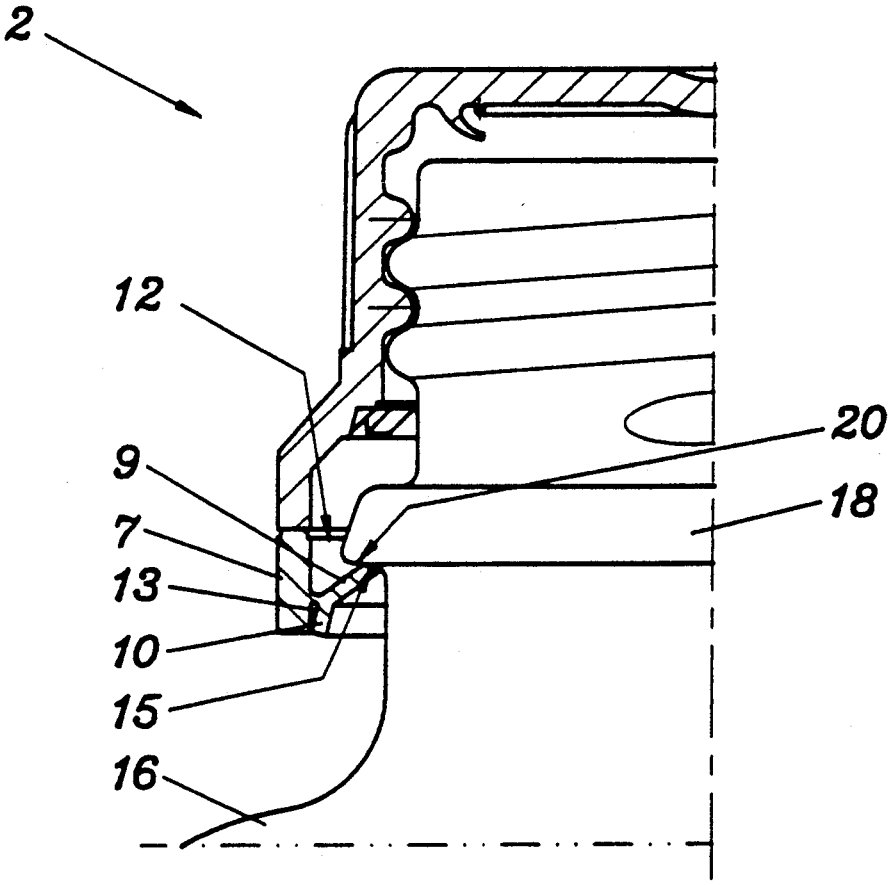
FIG. 7 shows the container closure in partial section in the first unscrewing phase.

The first phase of the unscrewing operation is shown in FIG. 7. The support surface 15 of the first leg 9 makes contact with the underside 20 of the annular bead 18, the outward motion of the first leg 9 being limited by the rocking motion, and hence also the contact of the second leg 10 with the originality ring while reducing the space 13. Due to the rigid design of and the rigid connection between the first leg 9 and the second leg 10 a further outward motion or even snapping of the first leg 9 is effectively prevented. Since the first leg 9 thus cannot escape, the support of the first leg 9 against the annular bead 18 leads to a stress on the connecting point between the originality ring 7 and the closure cap 2.

Figure 8:
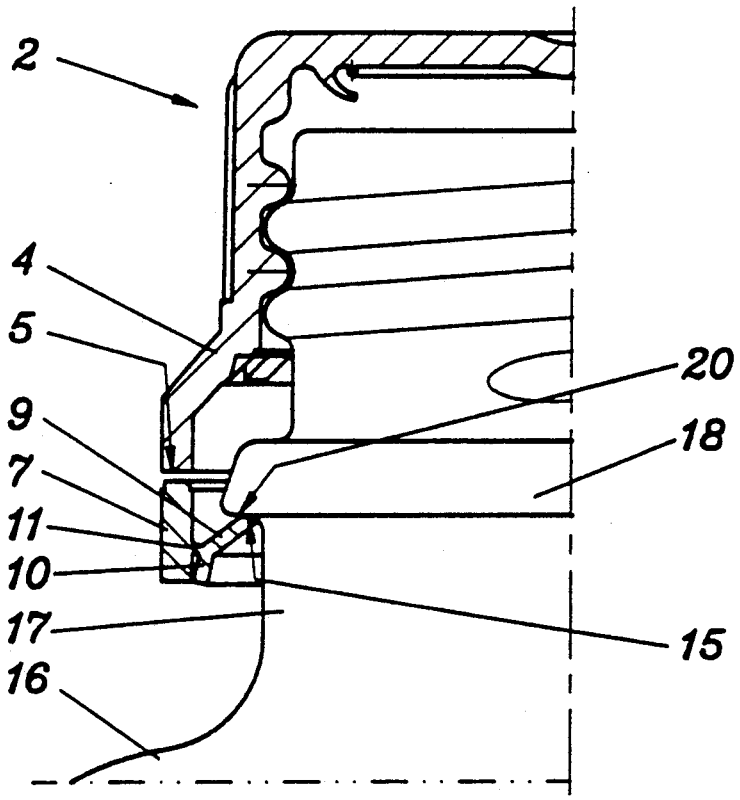
FIG. 8 shows the container closure in partial section during the separation of the originality ring.
Figure 9:
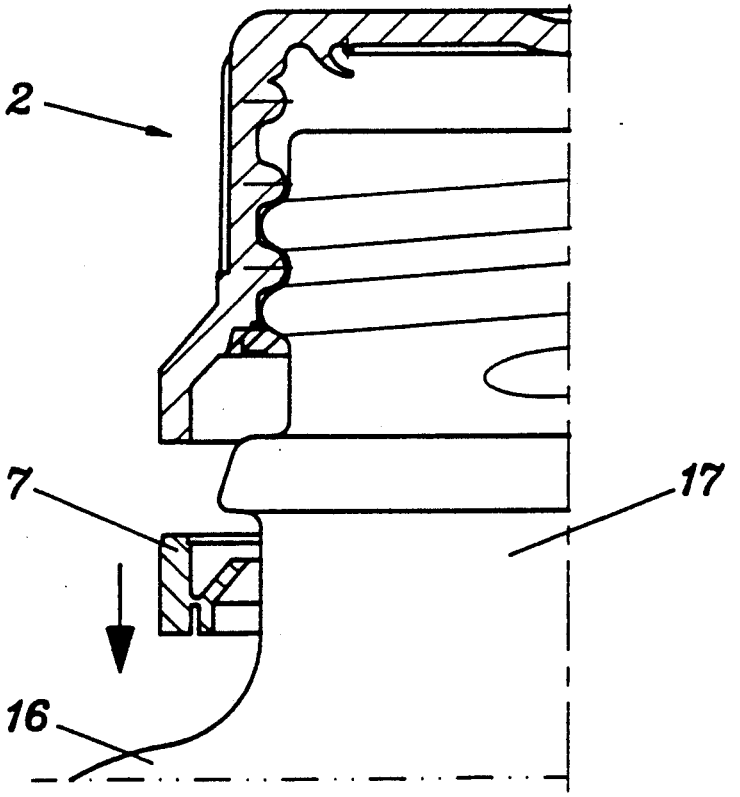
FIG. 9 shows the container closure in partial section, the originality ring having detached completely.

As may be seen in FIG. 8, this leads to a separation of the originality ring 7 and ultimately to the originality ring 7 dropping down and remaining on the container neck.

Figure 10:
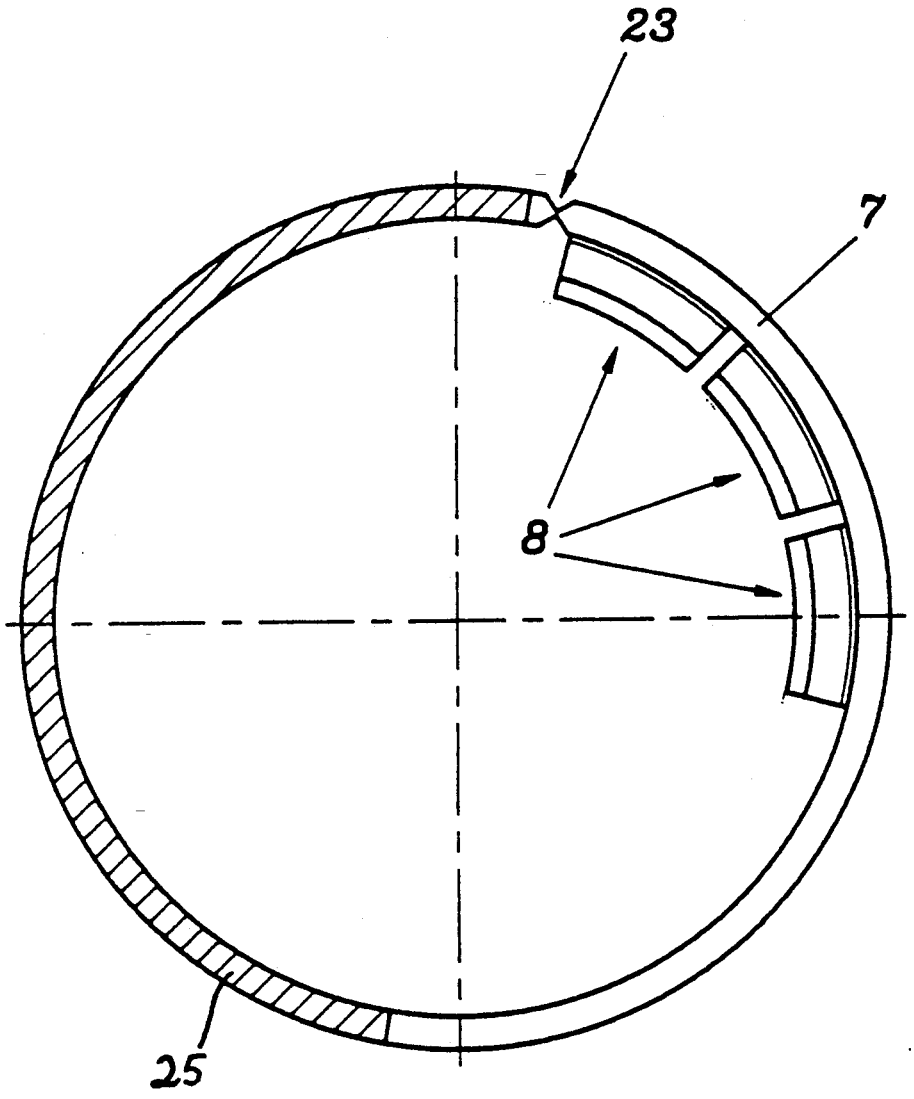
FIG. 10 is a top view of the originality ring according to another embodiment.

In FIG. 10 is shown the originality ring 7 in another embodiment. Only three rockers 8 are provided on the inner circumferential wall of the originality ring 7. Adjacent to one of the outer rockers 8 is a predetermined breaking point 23 in the originality ring 7. It is only in the shaded section 25 that the originality ring 7 is joined to the closure cap. When unscrewing, the originality ring 7 is stressed only in the area of the rockers 8 which leads to its being torn off in the area of the predetermined breaking point.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

LIST OF REFERENCE SYMBOLS

1 Container closure
2 Closure cap
3 Bottom wall
4 Circumferential wall
5 Face
6 Internal thread
7 Originality ring
8 Rocker
9 First leg
10 Second leg
11 Connecting web
12 Upper space
13 Lower space
14 Sliding surface
15 Support surface
16 Container
17 Container neck
18 Annular bead
19 Conical outside surface
20 Underside
21 External thread
22 Raised material sections
23 Predetermined breaking point
24 Face of the originality ring
25 Section

What is claimed is:

1. A closure cap (2) for a container (16) having an annular bead (18), said closure cap having a free circumferential rim and having at its free circumferential rim a break-away originality ring (7) with upper and lower edges, said originality ring being provided with retaining elements which cooperate with the annular bead (18) of the container (16), characterized in that the retaining elements comprise a plurality of individual rockers (8) each with a first leg (9) and a second leg (10) which are angularly connected to each other at a common fulcrum joint which is connected solely to the originality ring (7) by an elastic web (11) disposed intermediate the upper and lower edges of said originality ring, said first leg (9) pointing obliquely inward relative to the closure cap (2) and said second leg 910) pointing down, and said second leg (10) being disposed at an obtuse angle with respect to said first leg (9).

2. A closure cap according to claim 1, characterized in that both said legs (9, 10) are interconnected with each other.

3. A closure cap according to claim 1, characterized in that the first leg (9) and the second leg (10) each have a free end, and the free end of the first leg (9) is spaced further from the originality ring (7) than the free end of the second leg (10).

4. A closure cap according to claim 1, characterized in that the first leg (9) has a free end and an inside surface (14), and the first leg (9) points obliquely inward in such a manner that its inside surface (14) slides across the annular bead (18) when fastening the closure to the container, while both legs (9, 10) simultaneously perform a rocking motion, and in that the free end of the first leg (9) grips under the annular bead (18) after the closure cap is fastened.

5. A closure cap according to claim 1, characterized in that the first leg (9) has a free end, and at its free end a horizontal support surface (15).

6. A closure cap according to claim 1, characterized in that the first leg (9) is longer than the second leg (10).

7. A closure cap according to claim 1, characterized in that said originality ring has an annular wall, and the second leg (10) is spaced from the originality ring (7) and extends downwardly parallel to said annular wall of the originality ring (7).

8. A closure cap according to claim 1, characterized in that the originality ring (7) is fused to the closure cap (2) in several places.

9. A closure cap according to claim 1, characterized in that said first leg (9) and said second leg (100 are substantially rigid with respect to one another, and resist relative movement with respect to one another.

10. A closure cap (2) for a container 916) having an annular bead (18), said closure cap having a free circumferential rim and having at its free circumferential rim an originality ring (7) provided with retaining elements which cooperate with the annular bead (18) of the container (16), characterized in that the retaining elements comprise rockers (8) each with a first leg (9) and a second leg (10) which are connected to the originality ring (7) by an elastic web (11) that is common to both, said first leg (9) pointing obliquely inward relative to the closure cap (2) and said second leg (10) pointing down, and further characterized in that the originality ring (7) has a section (25) in which no rockers are located and the originality ring (7) having a predetermined breaking point of weakness 923), the rockers (8) being provided only unilaterally adjacent to the point of weakness (23) and the originality ring (7) being connected to the closure cap (2) only in said section (25) in which no rockers (8) are located.

11. A closure cap (2) for a container (16) having an annular bead (18), said closure cap (2) having a free circumferential rim and having at its free circumferential rim a break-away originality ring (7), said originality ring having an inner surface and being provided with retaining elements which cooperate with the annular bead (18) of the container 916), said retaining elements comprising a plurality of individual pivotally movable rocker legs (9) engageable with said annular bead (18) and movable between retracted positions enabling the legs (9) to be shifted past the annular bead (18), and extended blocking positions which prevent the legs (9) from being shifted past the annular bead (18), characterized by abuttable uni-directional blocking means located within the originality ring (7) for preventing pivotal movement of said pivotally movable legs (9) past their extended blocking positions, said blocking means comprising control rocker legs (10) respectively attached to and rigid with respect to the pivotally movable rocker legs (9), said control legs (10) being engageable with the inner surface of the originality ring (7) when the pivotally movable rocker legs (9) are in their extended blocking positions.

* * * * *